US009413074B2

(12) United States Patent
Enders et al.

(10) Patent No.: US 9,413,074 B2
(45) Date of Patent: Aug. 9, 2016

(54) METHOD AND ARRANGEMENT FOR MODELING ANTENNA EMISSION CHARACTERISTICS

(75) Inventors: Achim Enders, Braunschweig (DE); Robert Geise, Braunschweig (DE)

(73) Assignee: Technische Universitat Braunshweig, Braunschweig (DE)

( * ) Notice: Subject to any disclaimer, the term of this patent is extended or adjusted under 35 U.S.C. 154(b) by 214 days.

(21) Appl. No.: 14/007,012

(22) PCT Filed: Mar. 22, 2012

(86) PCT No.: PCT/EP2012/055098

§ 371 (c)(1), (2), (4) Date: Sep. 24, 2013

(87) PCT Pub. No.: WO2012/130721

PCT Pub. Date: Oct. 4, 2012

(65) Prior Publication Data

US 2014/0015725 A1 Jan. 16, 2014

(30) Foreign Application Priority Data

Mar. 25, 2011 (DE) ..... 10 2011 001 569

(51) Int. Cl.
*H01Q 13/18* (2006.01)
*H01Q 3/26* (2006.01)
(Continued)

(52) U.S. Cl.
CPC ..... *H01Q 13/18* (2013.01); *H01Q 3/26* (2013.01); *H01Q 13/22* (2013.01); *H01Q 21/005* (2013.01); *H01Q 21/0087* (2013.01); *Y10T 29/49016* (2015.01)

(58) Field of Classification Search
CPC ... H01Q 13/0233; H01Q 13/10; H01Q 13/12; H01Q 13/14; H01Q 13/18; H01Q 13/20; H01Q 13/203; H01Q 13/206; H01Q 13/22; H01Q 21/0043; H01Q 21/005; H01Q 21/0056; H01Q 21/0062; H01Q 13/26; H01Q 13/28; H01Q 13/30; H01Q 13/32; H01Q 21/0087
See application file for complete search history.

(56) References Cited

U.S. PATENT DOCUMENTS 2,635,188 A * 4/1953 Riblet ..... H01Q 21/0062 333/242
3,106,713 A * 10/1963 Murata ..... H01Q 13/203 333/237

(Continued)

FOREIGN PATENT DOCUMENTS

DE 102006057144 7/2008

OTHER PUBLICATIONS

Geise R, et al.; "A slotted waveguide setup as scaled instrument-landing-system for measuring scattering of an A380 and large objects", Antennas and Propagation (Eucap), 2010 Proceedings of the Fourth European Conference on, IEEE, Piscataway, N J, USA, Apr. 12, 2010.*

(Continued)

*Primary Examiner* — Sue A Purvis
*Assistant Examiner* — Patrick Holecek
(74) *Attorney, Agent, or Firm* — Rankin, Hill & Clark LLP

(57) ABSTRACT

A method and an arrangement for modeling antenna emission characteristics are disclosed.
A slotted microwave waveguide is implemented by separate mechanical modules having slot groups respectively implemented therein. For this purpose, the modules are arranged along at least one first spatial direction, so that the modules sectionally form a part of the delimitation of the waveguide. The waveguide formed can be fed by exciting a waveguide mode and the mode propagates through the interior of the module in the waveguide formed.
Screens are arranged in front of the modules, to partially cover the slot groups. Arbitrary emission characteristics can be simulated, wherein no separate feed network is necessary due to the use of a modular waveguide.

7 Claims, 7 Drawing Sheets

(51) Int. Cl.
*H01Q 13/22* (2006.01)
*H01Q 21/00* (2006.01)

(56) References Cited

U.S. PATENT DOCUMENTS

| | | | | | |
|---|---|---|---|---|---|
| 3,419,870 | A | * | 12/1968 | Wong | H01Q 3/22 343/768 |
| 3,720,953 | A | * | 3/1973 | Ajioka | H01Q 3/34 342/365 |
| 4,316,474 | A | * | 2/1982 | Spethmann | H01Q 13/22 219/691 |
| 4,825,219 | A | * | 4/1989 | Ajioka | H01Q 21/0062 343/768 |
| 5,726,666 | A | * | 3/1998 | Hoover | H01Q 13/22 343/767 |
| 2005/0146478 | A1 | | 7/2005 | Wang et al. | |
| 2010/0214150 | A1 | | 8/2010 | Lovberg et al. | |

OTHER PUBLICATIONS

J.D. Kraus; Antennas, 2nd edition, McGraw-Hill, New York, 1988, p. 628.

Dipl.-Ing. Robert Geise; "Scaled Measurements of Bistatic Radar-Cross-Sections and Landing—Course-Disturbances of the ILS" (English abstract included).

Geise R, et al.; "A slotted waveguide setup as scaled instrument-landing-system for measuring scattering of an A380 and large objects", Antennas and Propagation (Eucap), 2010 Proceedings of the Fourth European Conference on, IEEE, Piscataway, NJ, USA, Apr. 12, 2010.

International Search Report filed in PCT/EP2012/055098.

International Preliminary Report on Patentability filed in PCT/EP2012/055098.

* cited by examiner

METHOD AND ARRANGEMENT FOR MODELING ANTENNA EMISSION CHARACTERISTICS

The invention relates to a method and an arrangement for modeling antenna emission characteristics. In particular, the invention relates to the use of slotted waveguides, in which slotted openings are implemented along the longitudinal axis of a waveguide, to discharge oriented electromagnetic radiation.

Slotted waveguides are known in the prior art. For example, DE 102006057144 A1 discloses a slotted waveguide for use as an antenna in radar systems.

DE 101 26 469 A1 discloses a slotted emitter element having a special internal structure, specifically a web arranged opposite to the slot in the waveguide.

U.S. Pat. No. 7,355,555 discloses an antenna arrangement without wave guiding in the waveguide with additional feed network, which is based on a multilayer structure. This antenna arrangement is only individually adaptable with high expenditure.

Slotted waveguides have also been discussed and described in the relevant technical literature, for example, in J. D. Kraus, Antennas, 2nd edition, McGraw-Hill, New York, 1988, p. 628.

Earlier works, in which the inventors also participated, have shown that slotted waveguides having the special properties thereof of the wave guiding and the electromagnetic scalability are very suitable for modeling individual emission characteristics over a frequency range, the upper limit of which is only restricted by the mechanical implementability. The slotted elements act as individual elements of a group antenna. By exciting these elements differently, diagram shaping can be performed. The waveguide is not only used as a combining device of the individual emitters; it also assumes the nearly loss-free and defined feeding of the individual elements—in contrast to electronic activation and/or an additional feed network. The application for scaled measurements having instrument-supported landing systems (ILS) is to be mentioned here in particular. Such a method was described, for example, in R. Geise, J. Schueuer, L. Thiele, K. Notté, T. Beckers, A. Enders, "A slotted waveguide setup as scaled instrument-landing-system for measuring scattering of an A380 and large objects", EUCAP 2010, 12-16 Apr. 2010, Barcelona, Spain.

Reference is made to "Skalierte Messungen zu bistatischen Radarquerschnitten and Landekursverfälschungen des ILS [scaled measurements of bistatic radar cross sections and landing course corruptions of the ILS]", Dissertation by R. Geise, Cuvillier Verlag, ISBN 9783869555706 on the possibilities and technical details and also results of performed measurements.

It has been established that such a construction can replace the conventional complex and significantly more costly uses of group antennas for some applications. For example, in the case of a scaled instrument landing system (ILS), the main radiation direction can be established once and an emission diagram which is rapidly changeable with respect to time is not required, as in the case of beamforming. By setting the excitation amplitudes, pattern forming can be performed individually for ILS of various airports without the disadvantages of electronic beamforming. Specifically, in the case of conventional beamforming, a desired diagram form can only be achieved to a limited extent by electronic setting of the parameters, since, on the one hand, high circuitry expenditure is used and, on the other hand, unambiguous calibration methods are not always used, which are required for the correction of the crosstalk between the electronic components of the individual emitters and the individual emitters themselves. A waveguide having mechanical screen tolerates significantly more power than electronic components. However, setting the amplitudes and phases is initially more difficult in the case of a slotted waveguide, since the feed of the individual elements is predefined by the fundamental mode of the waveguide.

Calculations required to set a desired emission characteristic or a radiation pattern can fundamentally be carried out using known simulation programs for electromagnetic problems. Essentially only the layout of a (single) slot pair is simulated and optimized. The required excitation amplitudes and phases can be obtained by Fourier transform from the desired far field data. A slot pattern in a waveguide is then to be prepared according to these specifications of the simulation. According to the above-mentioned prior art, the emission amplitudes of the slot arrangements can be influenced, in that the slots are partially overlapped by metallic covers or screens. In spite of the promising results, modeling radiation patterns with slotted waveguides is a method which requires precise manufacturing and calculation of suitable waveguide or slot geometries for every application, however.

The object of the invention is to provide a cost-effective and flexible and also precise method and a corresponding device, which permit the modeling of desired antenna emission characteristics.

This object is achieved by the method according to the invention having the features of the Patent Claims and by devices having the features of the Patent.

The invention allows the excitation of individual elements of a slotted waveguide as a group antenna in a flexible manner.

The use of a waveguide as a combiner of the individual emitters of a group antenna, in which the excitation is fed as an electromagnetic wave, primarily makes extraordinarily simple feeding of the overall group antenna possible. Simple, for example, terminal feeding is made possible by the mechanical coupling of the modules according to the invention. A continuous space results, in which the fed wave propagates according to physical boundary conditions of the waveguide as a so-called mode. The slots in the waveguide arising by way of coupling of the modules are all supplied by the same feed, i.e. by the same progressing mode. An essential advantage is thus in the approach of using a single feed of a cavity, wherein this cavity is at least partially formed by modules which can be mechanically separated and coupled, however. The implementation of an additional feed network is thus superfluous. The waveguide or the waveguide array formed is excited, for example, by the H10 mode (in the case of rectangular waveguides). The waveguide (and therefore the antenna) can be separated into the modules and combined according to the invention, without having to take a feed network into consideration. This is a substantial advantage in relation to structures which provide a feed network implementation and feed network coupling. The solely mechanical ability to reconfigure the waveguide group antenna by arrangement and design of the individual modules thus also always automatically includes the expansion or change of the feed by the mode propagating in the waveguide.

The emission characteristic of the overall group antenna is achieved by the design of the individual modules, i.e., by the implementation and alignment of the slots and also by the arrangement of the screens, as described hereafter.

The invention makes use of the finding that not only the emitted amplitude, but rather also the phase of the slot arrangements can be influenced. If a slotted waveguide is analytically observed, it can be considered in the abstract as a system combined from individual slot arrangements. Since the excitation of the individual slot arrangements, which are arranged distributed along the waveguide, occurs substantially in the same way in all slots by way of the wave guiding in the waveguide, initially every slot arrangement can be considered individually, independently of the others. This segment-oriented observation according to the invention allows the individual influencing of each of the slot arrangements (segments), substantially independent of the other slot arrangements (segments) arranged adjacent thereto. According to the invention, the emission of each of the slot arrangements is then adapted, by varying both the coverage and the orientation depending on the desired radiation pattern. Specifically, it has been shown that the change of the orientation of a slot arrangement, in particular the mirroring of a slot structure on a plane through the longitudinal axis of the waveguide, results in a change of the phase of the emission in this segment or this slot arrangement, which initially appears contradictory, since all individual emitters (slot arrangements) are excited in-phase by the feed of the individual emitters by the fundamental mode.

A phase setting is accordingly achieved if an inclined slot arrangement is placed mirrored to another one, i.e. "upside down".

In the case of the symmetrical slot arrangements preferably used for this purpose (see above-mentioned prior art), a rotation about 180° corresponds to mirroring of the slot arrangement with respect to a plane which is spanned by the longitudinal axis of the waveguide and the emission normals of the modules.

A first aspect of the invention is thus to influence the amplitude and phase of each of the slot arrangements (segments of the waveguide) by selection of the coverage and the orientation of individual slot arrangements in a slotted waveguide, which has a plurality of slot arrangements.

Using this procedure, the invention allows a slotted waveguide having predefined emission characteristic to be provided, wherein slot arrangements having identical shape, but different coverage and different orientation are arranged along the longitudinal axis of the waveguide. Such a guide can be prepared, for example, by milling corresponding slot arrangements in a commercially available waveguide. If the waveguide thus prepared is combined with variable, for example, adjustable screens, an extraordinarily flexible antenna arrangement is provided.

Although this implementation according to the invention of slotted waveguides already provides particular advantages in the adaptability with respect to the known slotted waveguides, according to the idea of the invention, the described, abstract segmented observation (with respective amplitude adaptation and phase adaptation of each segment) is not restricted to a waveguide which is integrally connected (non-segmented) in reality. The abstract conception and observation of individual segments is rather also implemented in one possible embodiment of the invention in a mechanically segmented waveguide. In this case, these slot arrangements, which are initially considered as mathematically abstract segments according to the above explanations, are implemented as actual mechanically separate modules.

According to the invention, a plurality of (mechanical) modules are then used for the formation of the waveguide, which modules are arranged along one of a plurality of spatial directions and, optionally with further components, are parts of the delimitations of a slotted waveguide. Slot groups are respectively arranged in the modules, so that the slots can be moved into an arbitrary sequence by rearranging the modules and can be arranged in a desired number and extension. The resulting waveguide can have an arbitrary cross section (for example, rectangular, round, ellipsoidal, etc.).

In addition, the modules can be changed in the orientation thereof, for example, rotated, i.e., arranged in various orientations along the longitudinal axis. To model a desired emission characteristic, modules having suitable dimensions (for example, a dimension in the direction of the longitudinal axis of a wavelength of the mode in the waveguide) are combined and the desired slot pattern is formed by concatenation of the modules. The modules form a part of the delimitation of the waveguide in this case, so that the slots are implemented as openings in the waveguide. The modules can fundamentally be coupled directly to one another or to further parts; it is only necessary according to the invention that a rearrangement of various modules having slot groups arranged therein is possible. These modules correspond in the practical implementation thereof and, in the event of coupling to one another to form a waveguide, in the effect of the above-considered (abstract) segments of an integrally connected waveguide according to the invention having milled slot arrangements, for example.

According to the invention, a building block system can thus be provided and used according to the invention for a given wavelength of radiation, the parts of which can be used for rapid and simple construction of a slotted microwave waveguide.

Furthermore, it is provided that screen modules or screen parts are part of this building block system, wherein the screens can be arranged in front of the modules arranged along the longitudinal axis and depending on the desired emission characteristic.

The implementation of a suitable slotted antenna accordingly has the appearance that firstly the module set having slots suitable for the provided excitation wavelength is selected and the slotted modules are arranged along one or more spatial directions. The emission amplitude of the individual modules is finally achieved, in the case of the waveguide thus formed, with the arrangement of the screens in front of the modules. The optimization of the desired radiation pattern can be performed according to the invention by rearranging or exchanging corresponding screens in front of the slot groups with simultaneous measurement.

An essential aspect of the invention in the case of implementation using separate mechanical modules is to implement the waveguide having the slotted openings thereof no longer as a whole and for a specific use, but rather to at least partially form the waveguide from replaceable mechanical modules and thus permit problem-free rearrangement of the slotted openings. This is also true for the screens which are to be arranged in front of the modules. An extraordinarily flexible design of slotted waveguides is possible in this way and in situ optimization of the emission characteristic is achievable, since influence can be taken on the emission characteristic by simple replacement of modules or screens. The arrangement of the modules can be performed in the longitudinal direction of the waveguide for a linear, one-dimensional group antenna, for example, but the arrangement in a plurality of spatial directions is also fundamentally possible. For example, the modules can be arranged in a plurality of parallel spatial directions, to thus form two-dimensional group antennas. However, there is also the possibility of using the mechanically configurable arrangement principle for so-called conformal antennas, wherein modules having arbitrary angled parts can be connected and a quasi-curved waveguide results.

The modules can all be implemented similarly. However, modules can also be used which have a multiple of the length of other modules, for example. In addition, the slot groups in the modules can be similar, wherein each slot group contains one or more slots. This also applies accordingly for the screens, which are each implemented to cover a predefined section of one or also a plurality of modules. A screen can thus also extend over two adjacent emission modules; the dimensions of the screens are independent in this regard from the dimensions of the modules.

As will also become clear hereafter, the modules can be implemented nearly arbitrarily in the shape thereof. According to the invention, it must only be ensured that the modules are to be arranged and combinable along the longitudinal axis of the waveguide, or along the propagation direction of the waveguide mode. Therefore, both flat, slotted plates, which overlap an opening in the waveguide and only expose the slotted openings, and also, for example, slotted hollow bodies which themselves form a waveguide section by concatenation, come into consideration as modules.

Preferably, the modules are implemented and are arranged along the longitudinal axis in such a manner that, at least in the case of some of the modules, the slotted openings extend diagonally to the longitudinal axis of the waveguide.

Fundamentally, the invention is executable using modules which each only have a single slot. Each slot group therefore then only contains one single slot. The slot groups can also have a plurality of slots, however.

As described in the above-mentioned publication, slot pairs, which are arranged at an angle to one another, can advantageously be used for specific application purposes. The slots of these slot pairs are additionally arranged inclined at an angle to the longitudinal axis of the waveguide, but opposing in pairs, and thus form a divergent or convergent slot arrangement, for example. According to the above-mentioned example, the slots arranged inclined to one another can be integrated in a slot group on a module.

In the case of such a selected arrangement, a further aspect of the invention, which is first possible by way of the mechanical modularity of the system according to the invention, particularly comes to bear. Specifically, it is possible, by rotating one of the slotted mechanical modules, to perform a phase setting. This rearrangement or rotation is even simpler to implement than the implementation according to the invention of an integral slotted waveguide, in which mirrored slot arrangements were milled for the phase setting.

According to this preferred embodiment, at least two similarly implemented modules are accordingly used for the purpose of phase setting, wherein one of these modules is rotated by 180° about an emission axis. This emission axis extends perpendicularly to the slotted surface and the rotated module is arranged in relation to the other, non-rotated similar module in such a manner that the slot arrangements of both modules point in the same spatial direction for emission.

In other words, this rotation of a module is performed such that upon observation of the module and waveguide from the emission direction, a rotation by 180° about the emission axis is performed. The emission axis is thus maintained, however, the slot arrangement is "turned upside down". In the case of the mirror-symmetrical slot arrangements preferably used for this purpose (see above-mentioned prior art), this rotation corresponds to mirroring of the slot arrangement with respect to a plane which is spanned by the longitudinal axis of the waveguide and the emission normals of the module.

Thus, for example, if a module, the slots of which, upon observation of the entire waveguide, diverge upward, is rotated by 180° (mirrored) and installed at the same location (wherein the slots again point in the same direction), the phase of the individual emitter can be changed from 0° to 180° or vice versa. By rotating or mirroring one of the modules and covering it, all real amplitudes, i.e., also negative values because of the phase rotation by 180°, can be set for each individual emitter. The fact that all real amplitudes can be set means, mathematically, that any arbitrary emission diagram, which is mirror-symmetrical to the main axis of the antenna, can be implemented. Diagram forming or modeling of antenna emission characteristics is thus possible according to the invention by way of a solely mechanically configurable group antenna in the form of a slotted waveguide. The system and method according to the invention are not subject to the difficulties and inaccuracies of an electronic group antenna and the feed power thereof, which is limited by the electronic parts. In addition, because of the good scalability of a waveguide, the system can be used in a very broad frequency range for modeling antenna emission characteristics. For example, emission diagrams of real instrument landing systems can be remodeled very well at approximately 16 GHz in a correspondingly scaled measurement structure.

Although conventionally the emission direction occurs in a single preferred direction, the invention is not restricted in this meaning. By way of the possibilities of the modular implementation, it is fundamentally possible to perform emissions in different spatial directions, i.e., to arrange the modules at angles to one another, so that emission occurs in various spatial directions along the longitudinal extension of the waveguide, for example, also in opposing directions. This possibility is also possible by way of the modular building block concept of the microwave waveguide according to the invention.

The screens are preferably each assigned to individual modules having slot groups arranged therein. As already explained above, it is also possible to provide a screen with an extension over a plurality of modules. Furthermore, the height of the screen, i.e., the measure for the overlap of the slots, is to be selected such that the desired emission characteristic is achieved. A set of screens is preferably available for each module and is to be arranged according to the method, which allows a selection of various screen heights, i.e., various degrees of coverage. Furthermore, such a screen can optionally be arranged on each of the opposing ends of the slots, whereby further influence is taken on the modeling of the emission characteristic.

In an altered design, screens, which are adjustable with the aid of adjustment devices (for example, micrometer screws coupled to the module), can be arranged in front of individual modules or a plurality of modules.

In this case, at least some of the screens are provided with respective adjustment devices and the degree of coverage of the screens with the slots of the modules is variable by acting on these adjustment devices.

By actuating the adjustment device, the associated screen can be set in variable overlap with the slots as needed. In this manner, an individual screen can provide an adjustable overlap, without requiring a change between different screen sizes. This aspect of the adjustability can be implemented in manifold ways. For example, lateral rails can be arranged on the modules, in which the screens can slide (like a photographic slide in a receptacle of a projection device). A micrometer screw is seated above or below the module and can be actuated to set the screen in the guide.

Such an adjustment can also be coupled to a drive, for example, a stepping motor, so that predefined screen settings are retrievable. In this manner, various coverage schemata are retrievable for a waveguide assembled from modules, if these are stored beforehand in a control device.

According to the invention, furthermore a device for modeling antenna emission characteristics is provided, wherein a plurality of emission modules, which each have an emission surface interrupted by slots, is included. The emission modules are arranged along one spatial direction and optionally changing propagation direction of a waveguide mode to form a slotted waveguide. The device has a plurality of screens, which are arranged in front of the emission surfaces of the modules to cover at least one section of the slots. Furthermore, an exciter device is provided, which is arranged and activatable to excite a waveguide mode in the waveguide.

The waveguide accordingly consists of mechanical parts which can be separated from one another and joined together again, of which some are the so-called emission modules and others are the screens, which can partially cover the slots of the interrupted emission surfaces. The parts are combined in the above-explained manner to model arbitrary emission patterns.

In a preferred implementation of the device, an oblong carrier is provided, at which or on which the emission modules are arranged along the longitudinal axis of the carrier, to form the waveguide. In this design, the carrier forms a continuous connection of the modules. The carrier can be a rail, onto which the modules can be plugged or pushed one behind another and can be connected to form a continuous waveguide. The concatenation of the modules can be performed via corresponding connection systems, wherein the substantially radiation-opaque connection of the individual modules to one another is to be ensured. This can be performed, for example, via corresponding tongue-and-groove systems, wherein the modules are clamped with one another in the direction of the longitudinal axis and at the opposing ends of the waveguide via a corresponding clamping device. However, any arbitrary other connection mechanisms are also possible.

In a further preferred embodiment of the invention, the carrier itself is part of the delimitation of the waveguide.

In a particularly preferred design, the carrier is implemented in this case as a U-profile, wherein the U-profile forms three sides of a rectangular waveguide, for example. The slotted emission modules are placed in front of the free side of the U-profile, to cover this open side except for the slotted recesses. The coupling between emission modules and the U-profile is also possible here in any arbitrary manner, for example, by clamping using a corresponding clamping device, or magnetic mounts which produce the radiation opacity by formation of the contact regions (for example, tongue-and-groove system).

In an alteration of the design, the carrier is implemented as a C-profile, i.e., as a part of a round profile, and the emission modules can be plugged as clasps or rings onto the C-profile. These emission modules are then rotatable about the longitudinal axis of the C-profile and enclose the C-profile. Screens can then again be arranged in front of the emission modules. In this embodiment, by way of a rotation of an emission module, the slotted openings can lie over a section of the C-profile which forms a wall of the waveguide. The waveguide is then completely screened against radiation exit in this longitudinal section, since no section of the slotted openings is moved into congruence with the free region of the C-profile. The design of such a waveguide is extraordinarily flexible and simultaneously stable, since the individual parts are securely held on the carrier.

The invention also allows an arrangement of the modules along a plurality of axes. If a deflection device for the waves coupled into the waveguide is introduced between the modules, a corresponding arrangement is possible. For example, by way of a U-deflection, an arrangement of two or more module rows one over another can be implemented. An L-deflection or a 90° deflection allows the implementation of emissions along spatial axes which are perpendicular to one another. Corresponding deflection pieces are fundamentally known and can be combined with the modular construction according to the invention to form complex emission patterns, as explained hereafter on the basis of several embodiments. For example, a circular or polygonal arrangement of the modules would also be conceivable.

The invention will now be explained in greater detail on the basis of the appended drawings.

BRIEF DESCRIPTION OF THE DRAWINGS

FIG. 1*a* shows a first exemplary embodiment, which is suitable for application of the method according to the invention and represents a slotted waveguide according to the invention. A rectangular U-profile 1 is arranged with the longitudinal extension thereof along a spatial axis, which forms the longitudinal direction of the waveguide. An exciter device 2, which is only schematically shown in the illustration, is arranged in the U-profile. Fundamentally, any known and proven method for coupling into waveguides is applicable for coupling an electromagnetic field into the waveguide, as are also known to technical circles. In addition, a decentralized, lateral coupling can be performed or, depending on the application, also a central coupling or a coupling arranged at another position. Finally, the exciter device 2 can fundamentally also be used in each of the legs of the profile 1.

Figure 1A:
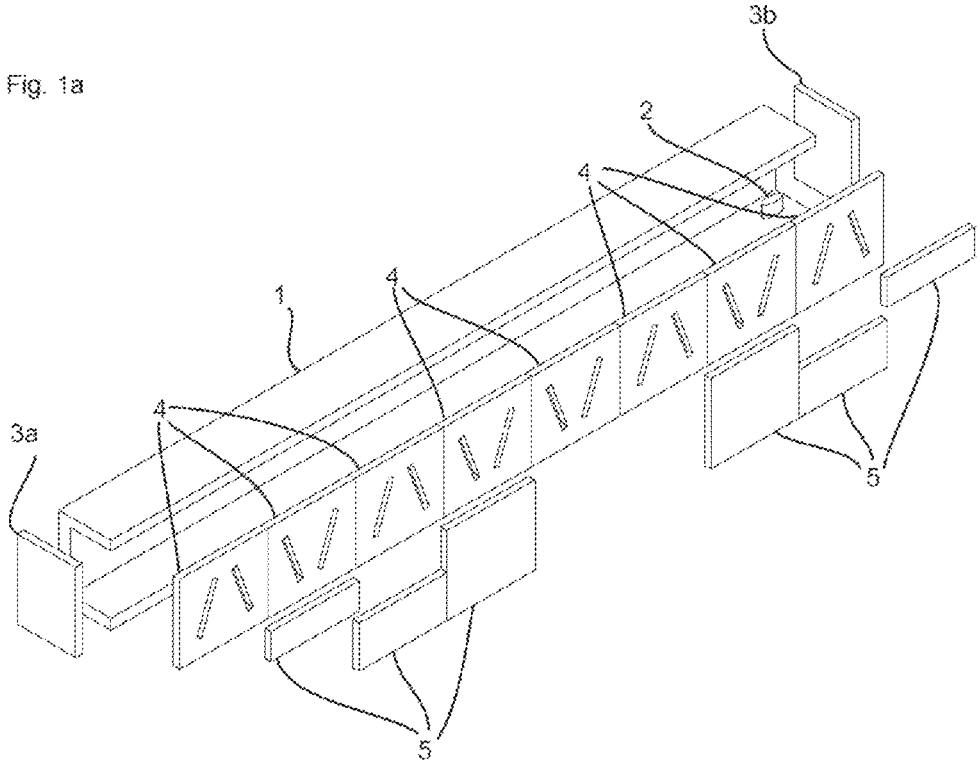
FIG. 1*a* shows a first embodiment of a modularly constructed waveguide in a schematic, perspective exploded view.

The U-profile 1 forms three lateral delimitations of the waveguide and is implemented as open at both longitudinal ends in this design. The open ends are closed by terminus covers 3*a*, 3*b*. These are implemented similarly in this illustration, since the design thereof is performed according to the known structure of a waveguide. One of the covers accordingly acts for example like an intended short-circuit at a distance of one-fourth of the waveguide wavelength to the last slot element 3*a*. At the opposite side of the waveguide, together with the feed device, a flange having coaxial waveguide (not shown) is located, so that a low-reflection terminus is implemented. The precise illustration in the schematic view is omitted, since these termini represent known prior art and are not essential for the invention.

Eight emission modules 4 are arranged adjacent to one another in front of the open front of the U-profile 1. The emission modules are tailored in the dimensions thereof to the dimensions of the waveguide 1. The emission modules 4 are otherwise implemented with identical sizes and are replaceable. Each of the emission modules 4 is equipped with slotted openings, which are implemented as symmetrical to one another with respect to a mirror axis and inclined. The emission modules 4 are arranged in front of the open side of the U-profile 1 such that the slots extend diagonally to the longitudinal extension thereof. It can be seen that in this example, the emission modules 4 are arranged with different orientation, i.e., some with slot distances decreasing upward and some with slot distances increasing upward. This reorientation, i.e., a rotation of an individual emission module by 180° with respect to a transverse axis to the longitudinal axis of the U-profile 1, causes a phase shift by pi with respect to the excitation of this module, i.e., the inversion of the sign of the amplitude for this module. In addition, in this example, the emission modules 4 are arranged symmetrically with respect to the middle of the longitudinal extension of the waveguide. The left four modules are thus mirror-symmetrical to the right four modules.

The modules are arranged in front of the open side of the U-profile and form, together with the U-profile 1 and the termini 3*a*, 3*b*, a slotted waveguide. The contact points between the modules 4 and the U-profile 1, the terminus parts 3*a*, 3*b* and the U-profile 1, and the modules 4, and also the connection of the modules to one another is implemented as radiation-opaque or interruption-free as possible for the currents flowing on the waveguide surface. All conventional mechanical connection methods come into consideration for this purpose, in particular, for example, the modules can be laterally equipped with grooves, so that each two modules are connected to one another in a radiation-opaque manner with introduction of an insertion element into the adjacent grooves. Suitable tongue-and-groove connections can also be implemented between the U-profile 1 and the radiation modules 4. However, arbitrary other connection concepts also come into consideration, in particular folded connections.

In the example shown, two slots extending diagonally to one another are arranged for each slot group per emission module. Fundamentally, however, each of the modules could also have more or fewer slots.

In the design in this exemplary embodiment, a total of six screens 5 are arranged in front of the emission modules 4. These screens overlap parts of the slotted openings in the emission modules 4. The arrangement of the screens is also symmetrical with respect to a center axis of the waveguide.

Figure 1B:
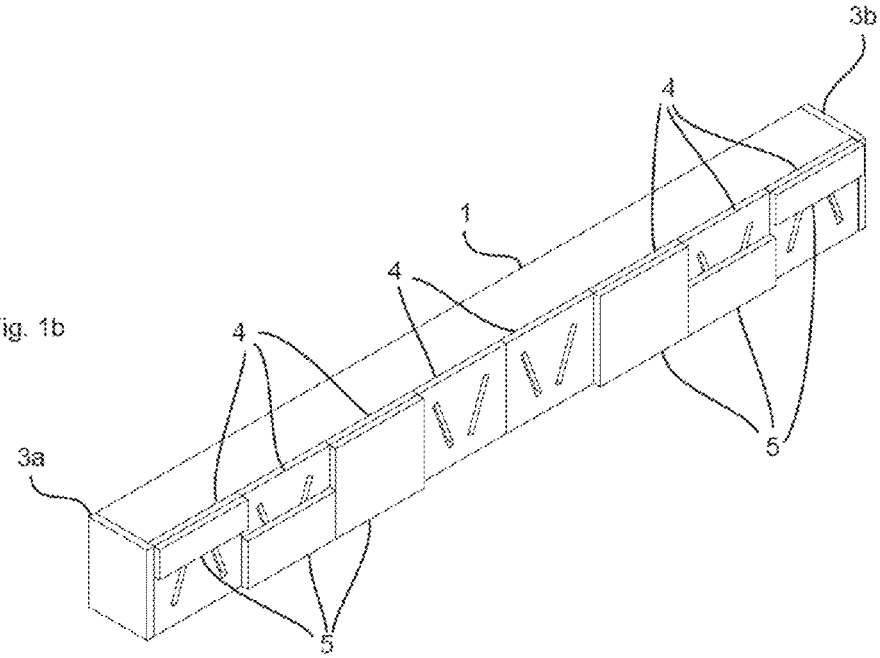
FIG. 1*b* shows the embodiment according to FIG. 1*a* in the installed state.

The modularly constructed waveguide is shown in installed form in FIG. 1*b*. The screens are arranged in front of the slotted openings and overlap parts of the openings, in order to model the desired emission characteristic. The screens 5 are to be fastened detachably in an arbitrary manner in front of the emission modules. In the illustrated form, for example, the screens 5 are arranged in front of the slotted openings using a detachable adhesive bond. The screens can also be implemented, however, such that they enclose the U-profile 1 on multiple sides as clamps or clasps and provide a corresponding coverage of the slotted openings.

A screen can also completely cover an emission module in order to entirely suppress the emission in this region, as in the case of every third emission module counted from the axial ends of the arrangement. Of course, a completely closed module, i.e., a slot-free module, can also be alternatively introduced into the row of the emission modules.

In the illustrated form, manifold emission characteristics can be modeled in a simple manner by combination of various slotted emission modules and screens. The dimensions of the U-profile and the slotted emission modules are adapted to the wavelength of the mode to be excited in the interior of the waveguide, of course. The fundamental findings about waveguides and the dimensions thereof in conjunction with the wavelength are known in the technical circles, however, and can also be inferred from the above-mentioned publications, for example.

Figure 1C:
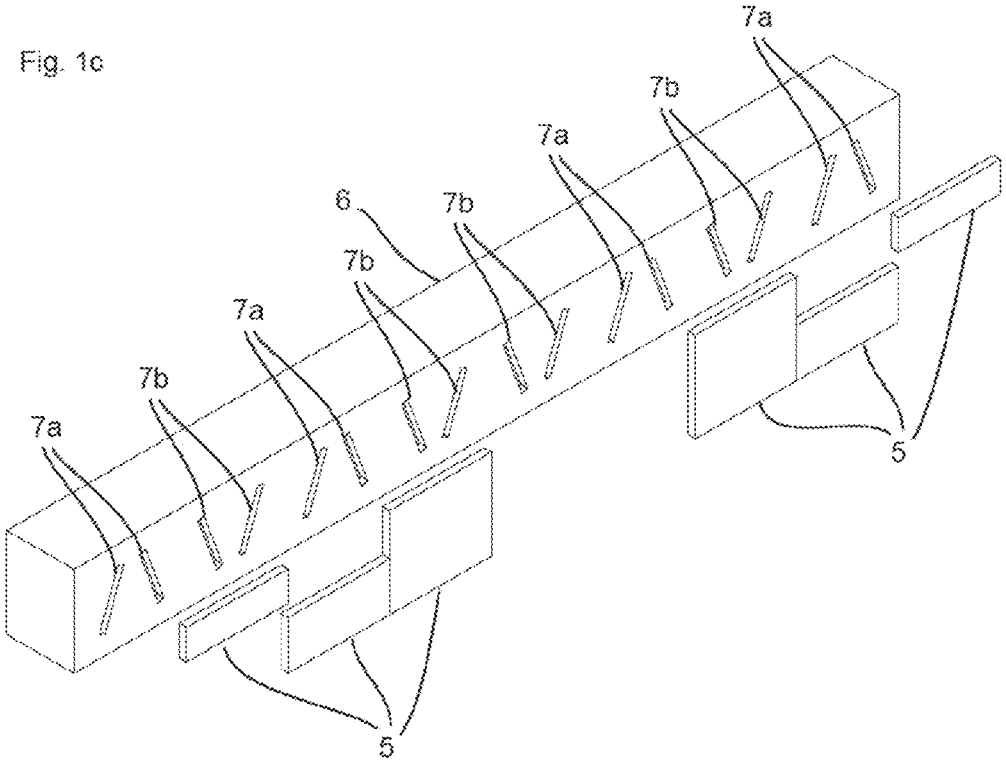
FIG. 1*c* shows a waveguide according to a second embodiment having a slot arrangement according to the first embodiment, but with integrally implemented waveguide in a schematic, perspective exploded view.
Figure 1D:
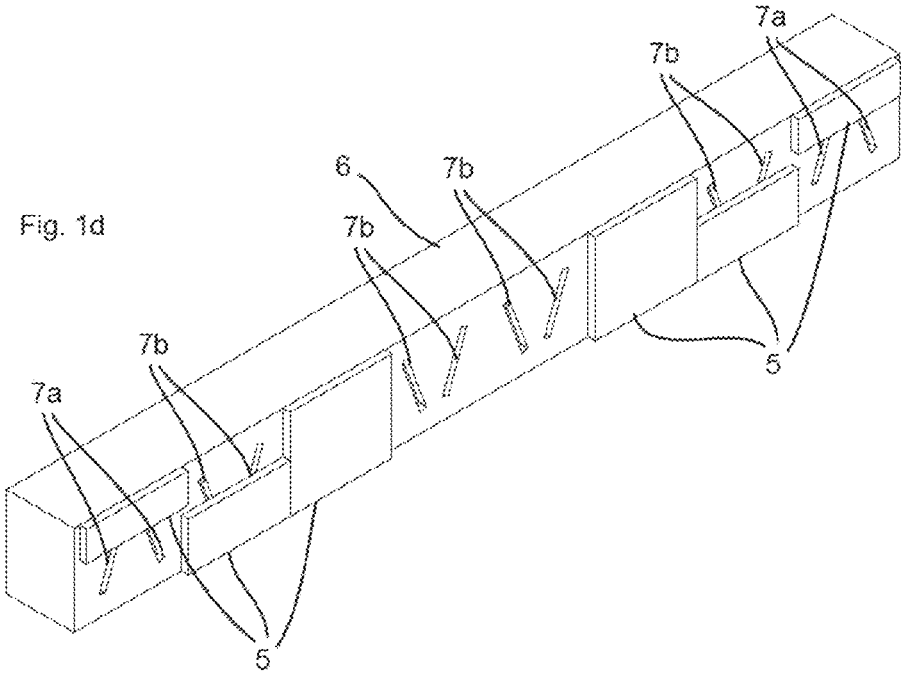
FIG. 1*d* shows the embodiment according to FIG. 1*c* in the installed state.

FIGS. 1*c* and 1*d* show a waveguide 6 according to the invention, wherein fundamentally the same pattern of slotted openings 7*a*, 7*b* was implemented as in the embodiment of FIGS. 1*a* and 1*b*.

In this design, however, the slots 7*a*, 7*b* are introduced into a commercially-available waveguide by milling or other machining. The waveguide is thus manufactured "from the solid" and does not consist of modules which can be mechanically decoupled. This design accordingly again takes up in the design thereof the fundamental mathematical or modeled abstraction and segments of the waveguide according to the invention. A (mathematical) segment is respectively formed here from a slot pair of the group 7*a* or 7*b*. The slot pairs 7*a* each have slots converging upward. In contrast, the slot pairs 7*b* diverge upward. Each of the slot pairs 7*a* is mirror-symmetrical to each of the slot pairs 7*b* with respect to a plane through the longitudinal axis of the waveguide and the primary emission direction. In relation to the emission from a 7*a* segment, a phase change from zero to pi or vice versa is achieved by this reorientation. Such an integrally formed waveguide is more robust, but less flexible than a guide having separable mechanical modules.

By arranging the screens 5, the emission amplitudes can also be substantially varied hereafter, however.

Figure 2A:
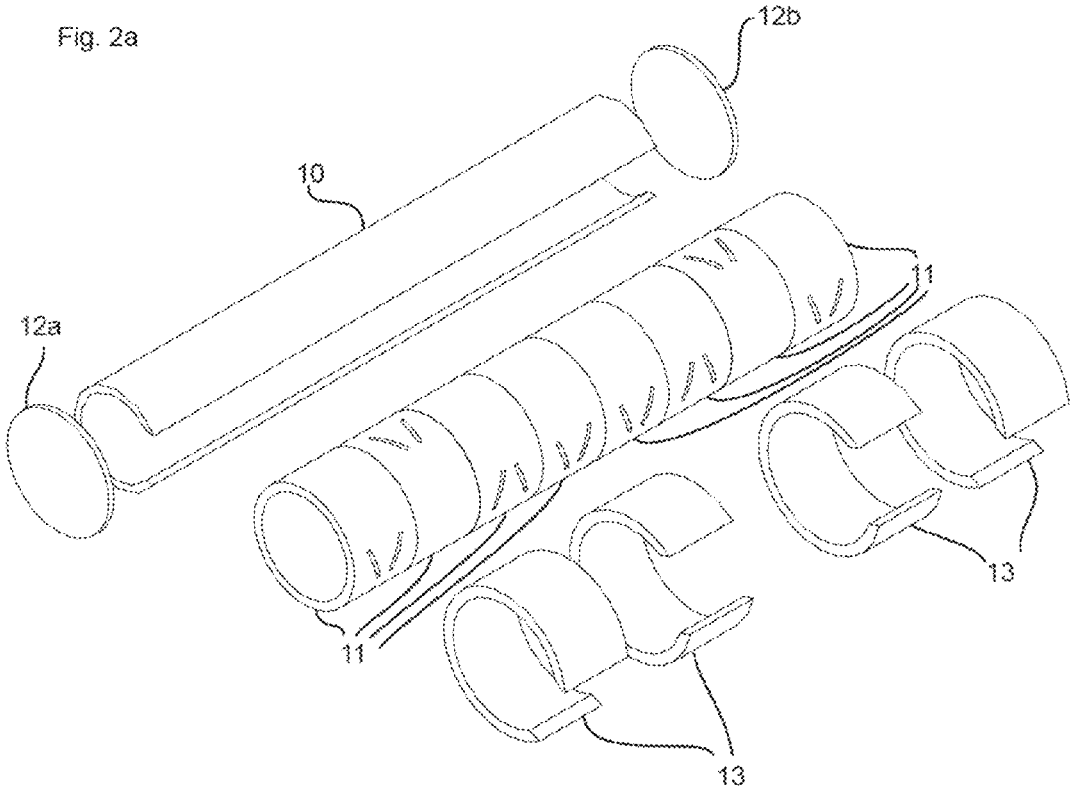
FIG. 2*a* shows a third exemplary embodiment according to the invention in a schematic, perspective exploded view.
Figure 2B:
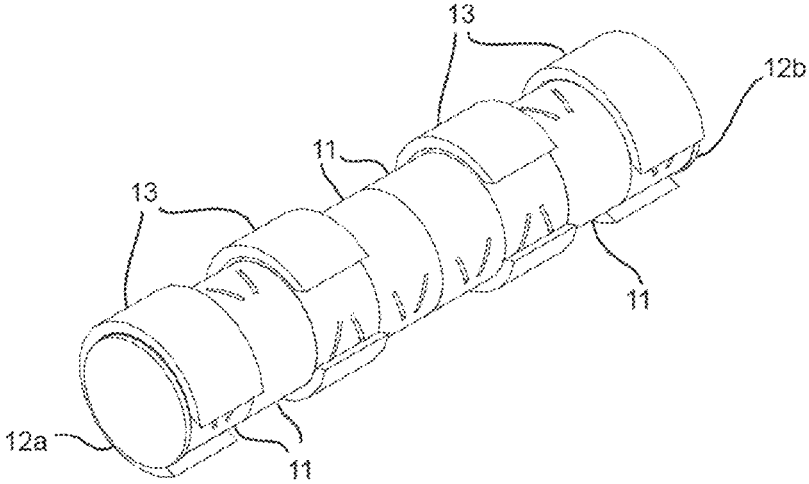
FIG. 2*b* shows the embodiment from FIG. 2*a* in an installed state.

FIGS. 2*a* and 2*b* show an alternative design of a device which is suitable for executing the method according to the invention and is implemented according to the invention.

In this design, a round profile is implemented as a C-profile 10 which is laterally open along the longitudinal axis. The exciter device is not visible in this illustration, but is to be arranged in principle similarly as in the above exemplary embodiment. The emission modules 11 are implemented as rings having slotted openings in this example. The open internal diameter of the emission modules 11 is adapted to the external diameter of the C-profile 10, so that the rings can be pushed onto the profile 10 and are rotatable about the longitudinal axis of the profile 10 by rotation, while sliding on the profile 10. In addition, the emission modules 11 can be drawn off the profile again laterally, to change the orientation of the slot arrangements.

Depending on the rotational position of the emission modules 11, the slotted openings lie in front of the open side of the C-profile 10 or over a wall surface of the profile. In this manner, active and passive emission regions can be provided (in an alternative design, various slot groups which are offset along the periphery could be arranged in each of the emission modules, which groups reach congruency with the opening in the profile 10, depending on the rotational direction—laterally drawing off the emission profiles would then also possibly no longer be necessary).

The lateral end termini 12*a* and 12*b* are adapted in the diameter thereof to the diameter of the emission modules 11. The most radiation-opaque and conductive connection is ensured between the emission modules themselves, in order to allow the rotation of the modules in relation to one another, on the one hand, and to ensure the radiation opacity of the system in these contact regions, on the other hand. The implementation of a tongue-and-groove connection along the periphery is again possible for this purpose.

The screens for the individual emission modules 11 are implemented as screen clasps 13. These are in turn pushed over the emission modules 11 and are also rotatable about the longitudinal axis of the waveguide, to cover a part of the slotted openings in the emission modules 11.

The installed design is shown in FIG. 2*b*. The waveguide thus implemented is suitable, by simple pivoting, for modeling numerous emission patterns. If necessary, of course, further components can improve the stability of such a construction. For example, axially arranged springy clamps can fix the overall structure in the axial direction, wherein nonetheless a rotation of the individual emission modules 11 in relation to one another remains possible.

The above explained exemplary embodiment is implementable in the scope of the invention also without a C-profile as a carrier. The individual emission modules are then coupled to one another, for example, by peripheral tongue-and-groove connections or provided with other known connections which are rotatable to one another. For this purpose, an external fixing or clamping device can also ensure the axial cohesion of the modules. In addition, a design can be implemented in which the circular modules can be coupled at discrete angular positions. It is then thus not necessary to provide a rotational connection, but rather each module can be axially separated from an adjacent module and coupled thereto again in another orientation (rotated by an angular amount).

Figure 3A:
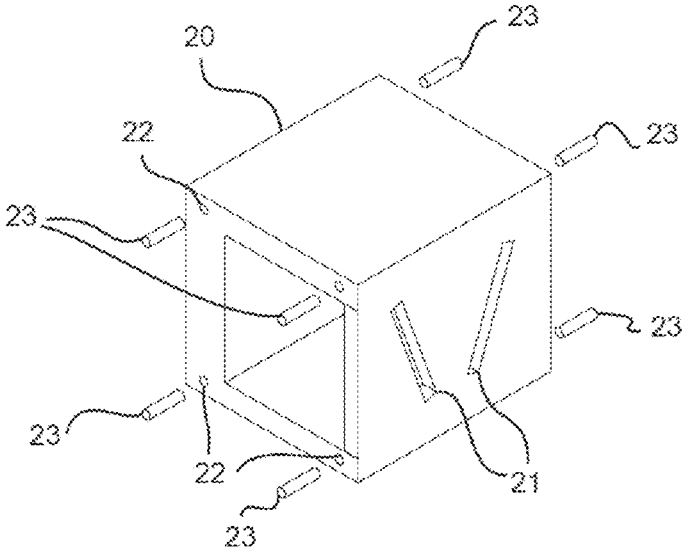
FIG. 3*a* shows a module according to a fourth embodiment of the invention in a schematic, perspective view.

Finally, FIG. 3*a* shows a mechanically implementable emission module having a slot group which is implemented as a cuboid element, which is open on opposing sides. An arrangement of a plurality of these cuboid elements adjacent to one another forms the desired waveguide. In FIG. 3*a*, the cuboid 20 is implemented with a slot group 21 and the cuboid has openings 22, via which a connection of the cuboid elements to one another is made possible using pins 23.

Figure 3B:
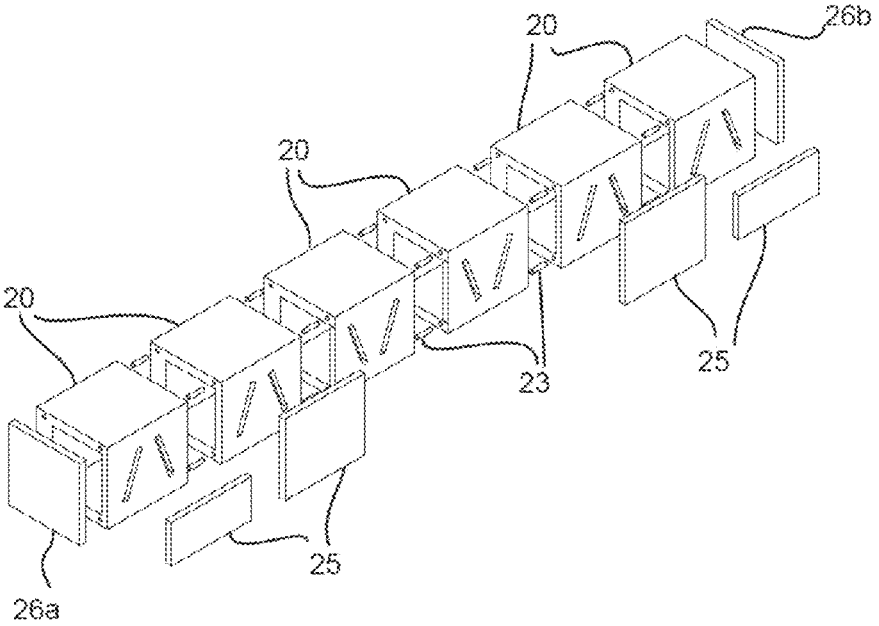
FIG. 3*b* shows the arrangement of a plurality of modules from FIG. 3*a* to form a waveguide.

FIG. 3*b* shows a corresponding arrangement, wherein screens 25 having different dimensions are again arranged in front of the individual cuboid elements 20. Lateral termini 26A, 26B close the waveguide, in that electromagnetic radiation is coupled in a routine manner, which exits at the open slot groups in the desired modeled form. For the coupling, special emission modules having corresponding suitable coupling devices can be provided, which are placed in the end region or in the middle region. Commercially available transitions of coaxial high-frequency cables (for example, in SMA technology) at the fundamental mode of the waveguide are preferable here.

It is apparent that an extraordinarily modular and flexible system is provided, to combine waveguides with arbitrary emission characteristics, wherein the length of the waveguide can be changed readily by supplementing further modules.

Figure 4A:
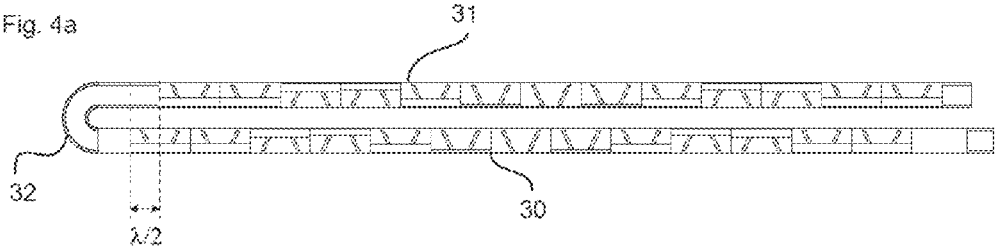
FIG. 4*a* shows a fifth embodiment of the invention in a schematic top view.
Figure 4B:
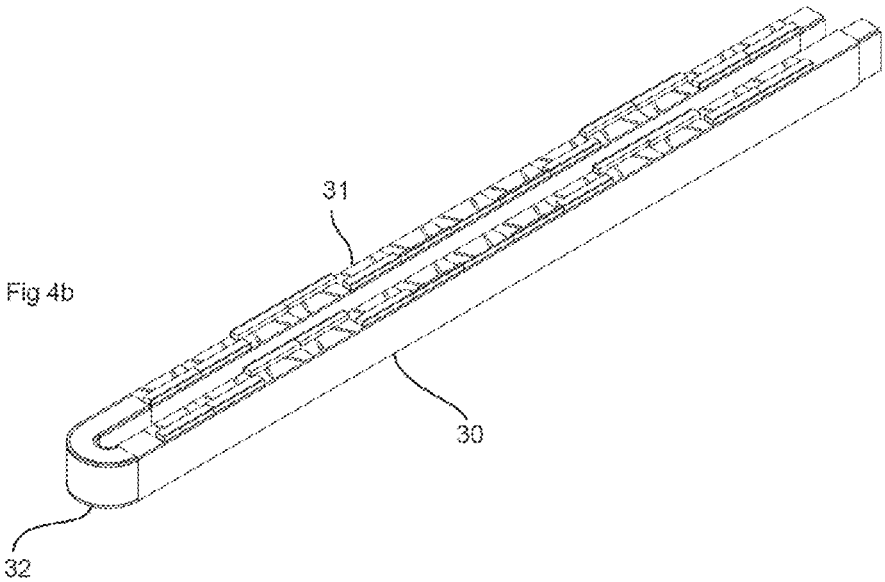
FIG. 4*b* shows the arrangement from FIG. 4*a* in a perspective view.

A further design of the method according to the invention and the device according to the invention is shown in FIGS. 4*a* and 4*b*.

In this design, the fact is taken into consideration that a wavelength in the waveguide (lambda HL) is always greater than the free space wavelength. This means automatically that the individual emitters (i.e., the slot pairs in this example according to the invention), which are arranged at the distance of the waveguide wavelength and are excited in-phase (or also in counter phase according to one idea of the invention), also have a distance which is greater than the free space wavelength.

In the case of a group antenna, this results in so-called "grating lobes" or adjacent lobes or lattice lobes in the emission characteristic, which are not desirable. In particular, interfering reflections can occur in the direction of these adjacent lobes.

According to the exemplary embodiment shown, two waveguides 30, 31 are arranged in parallel to one another. In this case, an offset in the direction of the array extension (i.e., in the longitudinal direction) of half of the waveguide wavelength is provided. A deflection part 32 in the form of a U-waveguide ensures that both waveguides are fed by the same excitation or mode and the two waveguides are excited in-phase.

In the main emission direction, the individual diagrams of the two offset waveguide arrangements 30, 31 are constructively superimposed, since the distance (parallel offset) between the U-legs is insignificant in the far field. In the region of the undesired grating lobes, in contrast, the emitted fields are destructively superimposed, so that these undesired adjacent lobes disappear, which can also be mathematically shown on the basis of the array factor.

In the configuration shown, the U-guide 32 is provided with coupling parts of different lengths, the length difference of which is half of one waveguide wavelength. The two waveguide arrangements 30, 31 having the slot pairs are implemented identically, in particular, the screens are also arranged identically in front of the slots in pairs.

Figure 5:
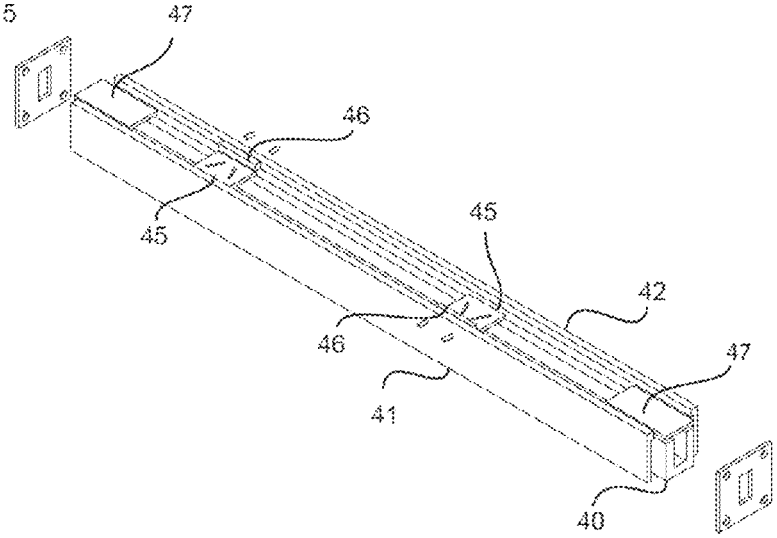
FIG. 5 shows a sixth embodiment of the invention in a schematic perspective view.

FIG. 5 shows the alternative structure of a device according to the invention.

An elongated U-profile 40 forms a three-sided delimitation for the waveguide. Two L-shaped receptacles 41, 42, which form, on the open side of the U-profile, a gap space between L-receptacles and end sides of the legs of the U-profile 40, are installed at the top and bottom on the two U-legs on the U-profile 40. This gap space is adapted in the width thereof to the thickness of the modules 45 having the slot pairs. The modules 45, implemented here as metal disks having slot pairs, are inserted laterally into the gap space, wherein the orientation thereof is freely selectable to set the phase. The two outside inserts 47 are fixed using screws on the U-profile 40, so that the modules cannot slip laterally between them. Screen parts 46, which determine the amplitude of each individual emitter module 45, are arranged on the top or bottom on the receptacle. They are also fastened thereon using screws or held at the position thereof via clamping.

Figure 6A:
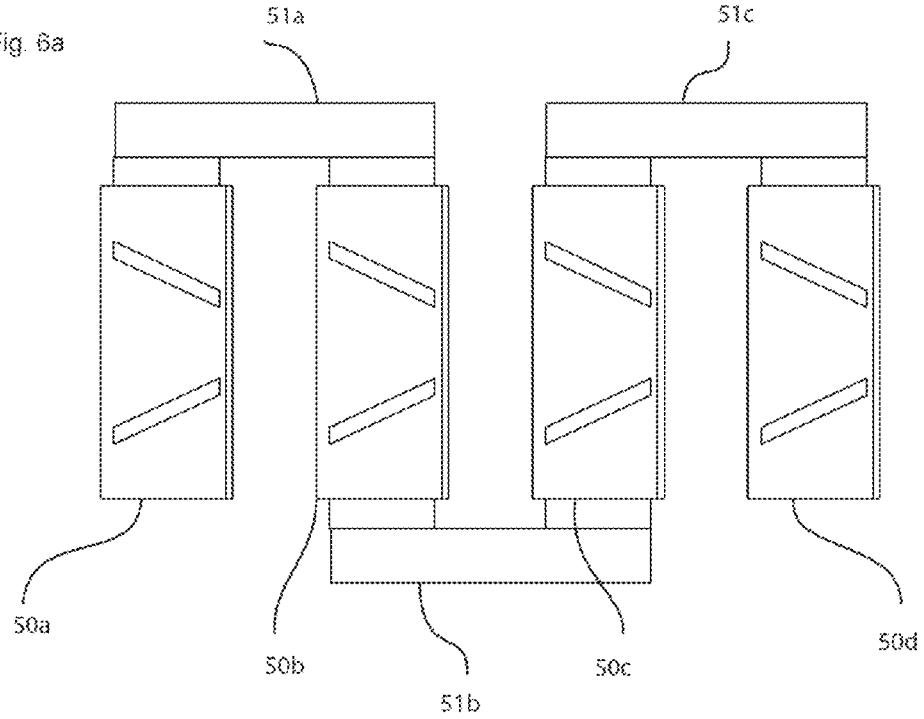
FIG. 6*a* shows a seventh embodiment of the invention in a schematic top view.
Figure 6B:
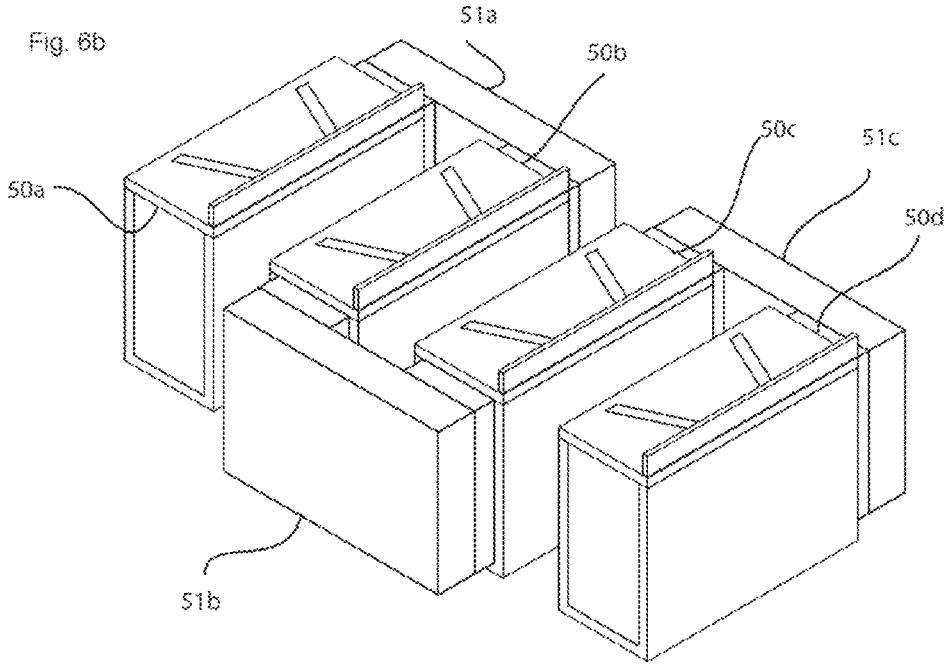
FIG. 6*b* shows the arrangement from FIG. 6*a* in a perspective view.

The embodiment according to the invention of FIGS. 6*a* and 6*b* concatenates four individual emission modules 50*a*, 50*b*, 50*c*, 50*d* in such a manner that vertically polarized radiation is emitted in a linear, one-dimensional array. The modules are coupled by U-connectors 51*a*, 51*b*, 51*c* having polygonal cross section. The amplitude can be set here by a screen placed in front and the phase (0° or 180°) can be influenced by rotating a module.

Such a design is possible in particular in the event of the implementation of radiation-opaque and mechanically-stable plug connections, since the individual parts (modules and diversions) are each implemented similarly. The modules can be arranged here at distances which are less than the free space wavelength and additionally generate vertical polarization.

Figure 7A:
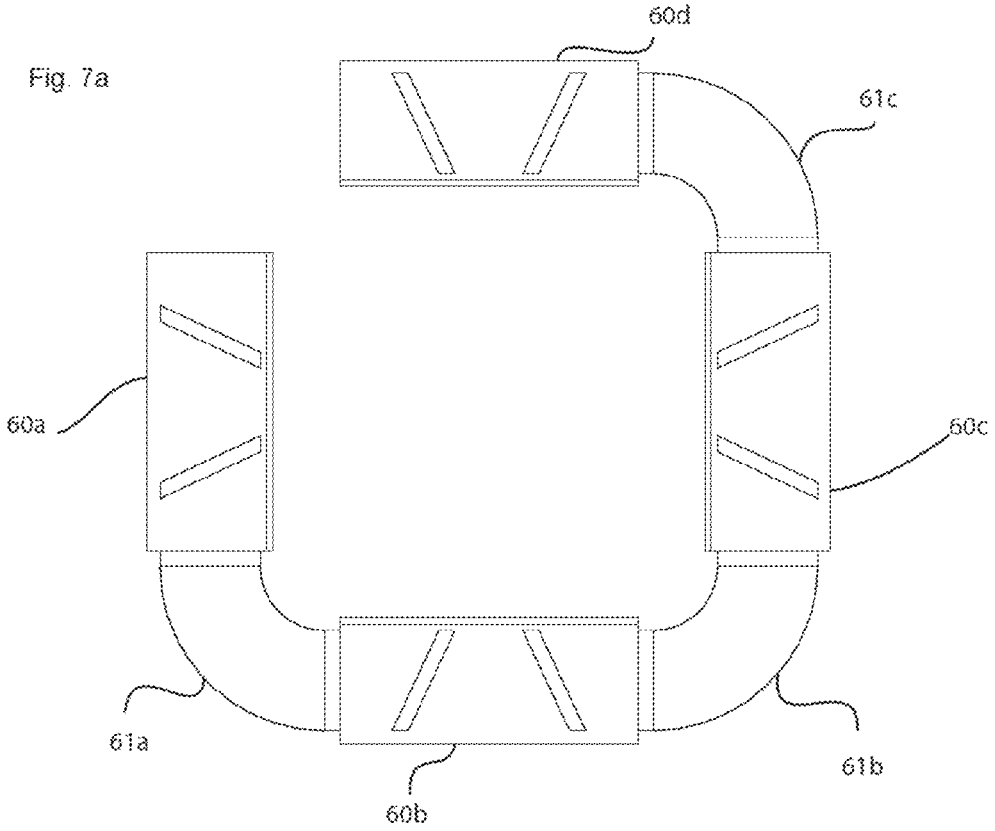
FIG. 7*a* shows a fifth embodiment of the invention in a schematic top view.
Figure 7B:
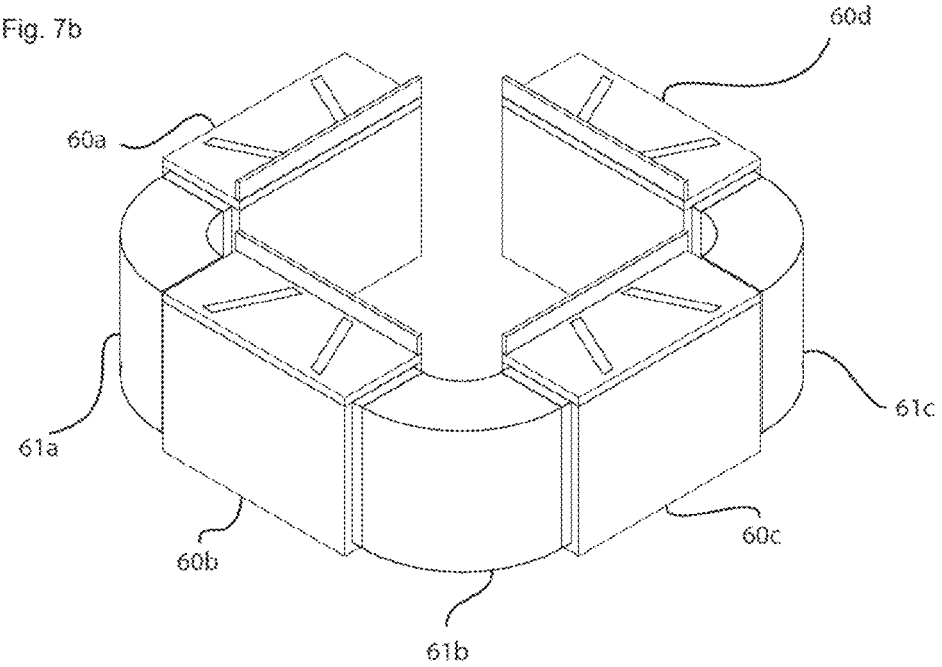
FIG. 7*b* shows the arrangement from FIG. 7*a* in a perspective view.

The group antenna shown as an embodiment in FIGS. 7*a* and 7*b* consists of four individual emitters 60*a*, 60*b*, 60*c*, 60*d*, wherein two opposing individual emitters (60*d* and 60*b*) have the same polarization (horizontal), while the other pair (60*a* and 60*c*) also has the orthogonal polarization (vertical) due to the orthogonal arrangement. The individual emitters 60*a*, 60*b*, 60*c*, 60*d* are respectively connected with 90° curve waveguides 61*a*, 61*b*, 61*c*, which are designed such that they excite the successively arranged individual emitters with a phase offset of 90° to the previous one. A circular emission behavior is thus physically generated. Opposing modules (60*b*-60*d* or 60*a*-60*c*) have a phase offset of 180° due to the deflections, so that a module must be rotated by 180° according to the invention for in-phase excitation.

In the case of a feed into module 60*a*, the vertical polarization is 90° in front of the horizontal polarization, so that a left-circular polarization is generated by this feed. In contrast, in the case of feed into module 60*d*, firstly the horizontal polarization is excited, so that right-circular polarization follows here. If one feeds into module 60*a* and simultaneously terminates module 60*d* with a short-circuit, only linear, vertical polarization remains, since module 60*b* and module 60*d* are excited by the deflections and the short-circuit both at the phase 0° and inverted at the phase 180°. Accordingly, in the case of feed into module 60*d* with short-circuit at module 60*a*, linear, horizontal polarization is obtained.

Elliptical polarization is also settable, in that the excitation behavior is set by screens on the respective module pairs. The setting of the excitation amplitudes for the horizontal or vertical modules can additionally also be used to optimize the axial ratio of the circular polarization.

Fundamentally, circular or elliptical polarization can also be possible using only two modules, for example, 60*a* and 60*b*. However, the paired modules partially compensate for the circumstance that one module always decouples some amount of power and the following module is then excited with correspondingly less power. Thus, axial ratios of nearly 0 dB may actually be set in the arrangement having four modules. For the described modes of excitation, there are also waveguide changeover switches, which could fit in the corners and could produce the described types of polarization by switching. A generic antenna is provided by this embodiment according to the invention, which can produce all types of polarization by changing over.

The use of this modular system for slotted waveguides is extensive. In particular, the use is suitable in the case of modeling of emission characteristics of the antennas for instrument landing systems (ILS), to obtain valuable indications of interference and optimization of such a system during the planning and during the analysis of airports.

Numerous expansions and alterations are conceivable in the scope of the invention. In particular, the modules and associated components such as screens and carriers can be manufactured from arbitrary materials, as long as they provide suitability for proper functioning of a waveguide. The device can also be used for waveguides of entirely different geometries and dimensions. It is essential that by way of the modular combination of components, a waveguide having nearly arbitrary emission characteristic can be implemented, wherein even the phasing is to be selected in individual ones of the emission modules as needed (at 0 or at pi), so that all real amplitudes are implementable for each individual emitter and therefore all emission diagrams, which are mirror-symmetrical to the emission axis, i.e., are a linear function over the emission angle, can be generated.

The invention claimed is:

1. A device for modeling antenna emission characteristics, comprising:

a plurality of emission modules which can be mechanically separated, and which each have an emission surface interrupted by slots, wherein the emission modules are arranged along one spatial direction to form a slotted microwave waveguide with a continuous space, which can be fed by exciting a waveguide mode, a wave propagating through the continuous space formed by the emission modules without a feed network, a plurality of separable screens, which are arranged in front of the emission surfaces of the emission modules to cover at least one section of the slots, the screens having a dimension so as to extend over one or two of the emission modules, an exciter device, which is arranged to excite the waveguide mode of microwaves in the waveguide, wherein the waveguide mode propagates in the spatial directions in which the emission modules are arranged, wherein each of said emission modules has a dimension of one wavelength of the mode along said spatial direction in which the emission modules are arranged.

2. The device according to claim 1, wherein the emission modules have identical cross sections and can be coupled to one another in an axial direction.

3. The device according to claim 1, wherein an oblong carrier is provided, on which the emission modules are arranged along a longitudinal axis of the carrier to form the microwave waveguide.

4. The device according to claim 3, wherein the carrier is implemented as a hollow body open along one longitudinal side, wherein the emission modules are to be arranged having the emission surfaces thereof in front of the open longitudinal side.

5. The device according to claim 4, wherein the carrier is implemented as a U-profile, and wherein the emission modules can be coupled to the U-profile in such a manner that the emission surface is arranged in front of the open longitudinal side of the U-profile.

6. The device according to claim 4, wherein the carrier is implemented as a C-profile, and wherein the emission modules are implemented as rings or clasps and can be coupled to the C-profile by enclosure in such a manner that the emission modules are rotatable about the longitudinal axis of the C-profile and can be aligned with the emission surface alternately in front of the open longitudinal side of the C-profile or with the emission surface in front of a wall section of the C-profile.

7. The device according to claim 1, wherein at least one waveguide deflection device is coupled between at least two of the emission modules, so that first group of the emission modules is arranged along a first spatial direction and a second group of the emission modules is arranged along at least one further spatial direction, wherein the first spatial direction and the at least one further spatial direction can extend in parallel or at an angle to one another.

* * * * *